US009410231B2

(12) United States Patent
Okamoto et al.

(10) Patent No.: US 9,410,231 B2
(45) Date of Patent: Aug. 9, 2016

(54) STEEL SHEET AND METHOD OF MANUFACTURING STEEL SHEET

(75) Inventors: Riki Okamoto, Tokyo (JP); Natsuko Sugiura, Tokyo (JP); Kohichi Sano, Tokyo (JP); Chisato Wakabayashi, Tokyo (JP); Naoki Yoshinaga, Tokyo (JP); Kaoru Kawasaki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 598 days.

(21) Appl. No.: 13/575,252

(22) PCT Filed: Jan. 31, 2011

(86) PCT No.: PCT/JP2011/051896

§ 371 (c)(1),
(2), (4) Date: Aug. 17, 2012

(87) PCT Pub. No.: WO2011/093490

PCT Pub. Date: Aug. 4, 2011

(65) Prior Publication Data

US 2012/0305144 A1 Dec. 6, 2012

(30) Foreign Application Priority Data

Jan. 29, 2010 (JP) ..... P2010-019193
Feb. 17, 2010 (JP) ..... P2010-032667

(51) Int. Cl.
*C22C 38/02* (2006.01)
*C23C 2/28* (2006.01)
(Continued)

(52) U.S. Cl.
CPC ... *C23C 2/28* (2013.01); *C21D 9/46* (2013.01); *C22C 38/001* (2013.01);
(Continued)

(58) Field of Classification Search
None
See application file for complete search history.

(56) References Cited

U.S. PATENT DOCUMENTS 6,319,338 B1 * 11/2001 Kawano et al. ..... 148/328
2004/0074575 A1 4/2004 Kashima et al.
(Continued)

FOREIGN PATENT DOCUMENTS

CN 1990894 A 7/2007
JP 1-184226 A 7/1989
(Continued)

OTHER PUBLICATIONS

English equivalent US documents are cited unded U.S Patent Documents Section—English equivalent, US 2011/0139315 A1 of Nakagaito et al., WO 2009/096344 A1—English equivalent, US 2010/0003541 A1 of Futamura et al., of WO 2007/066600 A1.*
(Continued)

*Primary Examiner* — Roy King
*Assistant Examiner* — Jophy S Koshy
(74) *Attorney, Agent, or Firm* — Birch, Stewart, Kolasch & Birch, LLP

(57) ABSTRACT

A steel sheet, including: as chemical components, by mass %, 0.05% to 0.35% of C; 0.05% to 2.0% of Si; 0.8% to 3.0% of Mn; 0.01% to 2.0% of Al; equal to or less than 0.1% of P; equal to or less than 0.05% of S; equal to or less than 0.01% of N; and the balance including iron and inevitable impurities, wherein the steel sheet comprises 50% or more of a ferrite phase, a bainite phase, and a tempered martensite phase, 3% or more of a retained austenite phase, and 50% or more of the crystal grains of the retained austenite phase satisfy Expression 1, wherein a carbon concentration at a position of center of gravity is Cgc and a carbon concentration at a grain boundary is Cgb.

17 Claims, 1 Drawing Sheet

(51) Int. Cl.

| | |
|---|---|
| ***C21D 9/46*** | (2006.01) |
| ***C22C 38/04*** | (2006.01) |
| ***C22C 38/06*** | (2006.01) |
| ***C23C 2/02*** | (2006.01) |
| ***C23C 2/06*** | (2006.01) |
| ***C22C 38/00*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C23C 2/02* (2013.01); *C23C 2/06* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2004/0202889 | A1* | 10/2004 | Fujita et al. | 428/659 |
| 2010/0003541 | A1* | 1/2010 | Futamura et al. | 428/659 |
| 2011/0139315 | A1* | 6/2011 | Nakagaito et al. | 148/533 |

FOREIGN PATENT DOCUMENTS

| | | | | |
|---|---|---|---|---|
| JP | 04-088125 | A | 3/1992 | |
| JP | 2003-171736 | A | 6/2003 | |
| JP | 2003-306746 | A | 10/2003 | |
| JP | 2006-274418 | A | 10/2006 | |
| JP | 2007-154283 | A | 6/2007 | |
| JP | 2007-321233 | A | 12/2007 | |
| JP | 2008-056993 | A | 3/2008 | |
| JP | 2008-231480 | A | 10/2008 | |
| JP | 2008-231541 | A | 10/2008 | |
| JP | 2009-203548 | A | 9/2009 | |
| WO | WO 2007066600 | A1 * | 6/2007 | C23C 2/06 |
| WO | WO 2009096344 | A1 * | 8/2009 | C22C 38/06 |

OTHER PUBLICATIONS

Chinese Office Action and English translation of the Search Report, dated Sep. 2, 2013, for Patent Application No. 201180007358.1.

International Search Report for PCT/JP2011/051896 dated Apr. 19, 2011.

Korean Office Action issued in Korean Patent Application No. 10-2012-7020375 issued on Feb. 28, 2014.

* cited by examiner

STEEL SHEET AND METHOD OF MANUFACTURING STEEL SHEET

TECHNICAL FIELD

The present invention relates to a steel sheet and a method of manufacturing a steel sheet. The steel sheet is a high-strength steel sheet which is appropriate for a structural material of a vehicle or the like used mainly by being press worked and has excellent elongation, V-bendability, and increased press-forming stability.

Priority is claimed on Japanese Patent Application No. 2010-019193, filed on Jan. 29, 2010, and Japanese Patent Application No. 2010-032667, filed on Feb. 17, 2010, the contents of which are incorporated herein by reference.

BACKGROUND ART

Excellent elongation and V-bendability in addition to high strength are required of a steel sheet used in the vehicle body structure of a vehicle.

It is known that a TRIP (Transformation Induced Plasticity) steel sheet containing a retained austenite phase exhibits high strength and high elongation due to the TRIP effect.

In Patent Document 1, for the purpose of further increasing the elongation of retained austenite steel, a technique of ensuring a high fraction of a retained austenite phase thereby controlling two kinds of ferrite phases (bainitic ferrite and polygonal ferrite phase) is disclosed.

In Patent Document 2, for the purpose of ensuring elongation and shape taxability, a technique of specifying the shape of an austenite phase as an aspect ratio is disclosed.

In Patent Document 3, for the purpose of further enhancing elongation, a technique of optimizing the distribution of an austenite phase is disclosed.

In addition, in Patent Documents 4 and 5, a technique of enhancing local ductility through uniformization of the structure is disclosed.

RELATED ART DOCUMENTS

Patent Documents

[Patent Document 1] Japanese Unexamined Patent Application, First Publication No. 2006-274418

[Patent Document 2] Japanese Unexamined Patent Application, First Publication No. 2007-154283

[Patent Document 3] Japanese Unexamined Patent Application, First Publication No. 2008-56993

[Patent Document 4] Japanese Unexamined Patent Application, First Publication No. 2003-306746

[Patent Document 5] Japanese Unexamined Patent Application, First Publication No. H04-88125

Non-patent Document

[Non-patent Document 1] M. Takahashi: IS3-2007, (2007), 47-50.

DISCLOSURE OF THE INVENTION

Technical Problem

Retained austenite steel is steel in which a retained austenite phase is contained in a steel structure by increasing the C concentration of austenite through control of ferrite transformation and bainite transformation during annealing. However, the retained austenite steel has a mixed structure and thus may not exhibit high V-bendability (local bendability). Therefore, in the above-mentioned technique, obtaining both higher elongation and V-bendability required of a current high-strength steel sheet is not achieved.

In addition, the TRIP effect has temperature dependence, and in actual press forming, the temperature of a die changes during press forming. Therefore, in a case where a TRIP steel sheet is subjected to press forming, defects such as cracking may occur in an initial stage of press forming at, for example, about 25° C. and in a late stage of the press forming at, for example, about 150° C., and thus there is a problem with press-forming stability.

Therefore, in addition to high elongation and V-bendability, realizing excellent press-forming stability without depending on a temperature change during press forming is an object in practice.

An object of the present invention is to provide a steel sheet having higher elongation and V-bendability compared to those of the related art and further having excellent press-forming stability, and a method of manufacturing the same.

Means for Solving Problem

The present invention employs the following measures in order to accomplish the above-mentioned object.

(1) According to a first aspect of the present invention, a steel sheet is provided, including: as chemical components, by mass %, 0.05% to 0.35% of C; 0.05% to 2.0% of Si; 0.8% to 3.0% of Mn; 0.01% to 2.0% of Al; equal to or less than 0.1% of P; equal to or less than 0.05% of S; equal to or less than 0.01% of N; and the balance including iron and inevitable impurities, wherein the steel sheet comprises 50% or more of a ferrite phase, a bainite phase, and a tempered martensite phase, 3% or more of a retained austenite phase, and 50% or more of the crystal grains of the retained austenite phase satisfy Expression 1, wherein a carbon concentration at a position of center of gravity is Cgc and a carbon concentration at a grain boundary is Cgb:

$$Cgb/Cgc \geq 1.2 \quad \text{(Expression 1).}$$

(2) The steel sheet described in (1) may further include, in the chemical components, by mass %, at least one of: 0.01% to 0.5% of Mo; 0.005% to 0.1% of Nb; 0.005% to 0.2% of Ti; 0.005% to 0.5% of V; 0.05% to 5.0% of Cr; 0.05% to 5.0% of W; 0.0005% to 0.05% of Ca; 0.0005% to 0.05% of Mg; 0.0005% to 0.05% of Zr; 0.0005% to 0.05% of REM; 0.02% to 2.0% of Cu; 0.02% to 1.0% of Ni; and 0.0003% to 0.007% of B.

(3) In the steel sheet described in (1), an average grain size of the crystal grains may be equal to or less than 10 μm, and an average carbon concentration in the retained austenite phase may be equal to or higher than 0.7% and equal to or less than 1.5%.

(4) In the steel sheet described in (1), 40% or more of the crystal grains may be small-diameter crystal grains having an average grain size of equal to or greater than 1 μm and equal to or less than 2 μm, and 20% or more of the crystal grains may be large-diameter crystal grains having an average grain size of equal to or greater than 2 μm.

(5) In the steel sheet described in (4), 50% or more of the small-diameter crystal grains may satisfy Expression 2, wherein a carbon concentration at a position of center of gravity is CgcS and a carbon concentration at a grain boundary is CgbS, and 50% a more of the large-diameter crystal grains may satisfy Expression 3, wherein a carbon concentration at a position of center of gravity is CgcL and a carbon concentration at a grain boundary is CgbL:

$$CgbS/CgcS>1.3 \quad \text{(Expression 2)}$$

$$1.3>CgbL/CgcL>1.1 \quad \text{(Expression 3).}$$

(6) The steel sheet described in any one of (1) to (5) may have a galvanized film provided to at least one surface.

(7) The steel sheet described in any one of (1) to (5) may have a galvannealed film provided to at least one surface.

(8) According to a second aspect of the present invention, a method of manufacturing a steel sheet is provided, including: a hot-rolling process of manufacturing a hot-rolled steel sheet by performing hot rolling on a slab having the chemical components described in (1) or (2) at a finishing temperature of equal to or higher than 850° C. and equal to or less than 970° C.; an air-cooling process of performing air cooling on the hot-rolled steel sheet for a time of equal to or longer than 1 second and equal to or shorter than 10 seconds; a coiling process of cooling the air-cooled hot-rolled steel sheet to a temperature range of equal to or less than 650° C. at an average cooling rate of equal to or higher than 10° C./sec and equal to or less than 200° C./sec and thereafter coiling the steel sheet in a temperature range of equal to or less than 650° C.; a cold-rolling process of performing pickling on the coiled hot-roiled steel sheet at a rolling reduction ratio of equal to or higher than 40% and thereafter performing cold rolling on the steel sheet, thereby manufacturing a cold-rolled steel sheet; an annealing process of performing annealing on the cold-rolled steel sheet at a maximum temperature of equal to or higher than 700° C. and equal to or less than 900° C.; a holding process of cooling the annealed cold-rolled steel sheet in a temperature range of equal to or higher than 350° C. and equal to or less than 480° C. at an average cooling rate of equal to or higher than 0.1° C./sec and equal to or less than 200° C./sec, and holding the steel sheet in this temperature range for a time of equal to or longer than 1 second and equal to or shorter than 1000 seconds; and a final cooling process of primarily cooling the cold-rolled steel sheet in a temperature range from 350° C. to 220° C. at an average cooling rage of equal to or higher than 5° C./sec and equal to or less than 25° C./sec, and secondarily cooling the steel sheet in a temperature range from 120° C. to near room temperature at an average cooling rate of equal to or higher than 100° C./sec and equal to or less than 5° C./sec.

(9) In the method of manufacturing a steel sheet described in (8), rolling may be performed with a strain amount of equal to or less than 20% in each of final two passes in the hot-rolling process.

(10) In the method of manufacturing a steel sheet described in (8), a slab which is re-heated to 1100° C. or higher after being cooled to 1100° C. or less may be used in the hot-rolling process.

(11) The method of manufacturing a steel sheet described in (8) may further include an immersion process of immersing the steel sheet in a hot-dip galvanizing bath after the holding process.

(12) The method of manufacturing a steel sheet described in (11) may further include an alloying treatment process of performing an alloying treatment in a range of equal to or higher than 500° C. and equal to or less than 580° C. after the immersion process.

Advantageous Effects of Invention

According to the above-described measures, the C concentration gradient in the retained austenite phase is appropriately controlled, so that an extremely stable retained austenite phase may be obtained. As a result, due to the TRIP effect of the retained austenite, extremely high elongation and high V-bendability may be exhibited despite high strength. In addition, in the case where the amounts of the small-diameter crystal grains and the large-diameter crystal grains are appropriately controlled, the stability of the TRIP function of the retained austenite may be dispersed. Therefore, excellent press-forming stability that does not depend on a temperature change during press-forming may be exhibited. In addition, in a case where the C concentration gradient of the small-diameter crystal grains and the C concentration gradient of the large-diameter crystal grains are appropriately controlled, superior press-forming stability may be exhibited.

DESCRIPTION OF EMBODIMENTS

Figure 1:
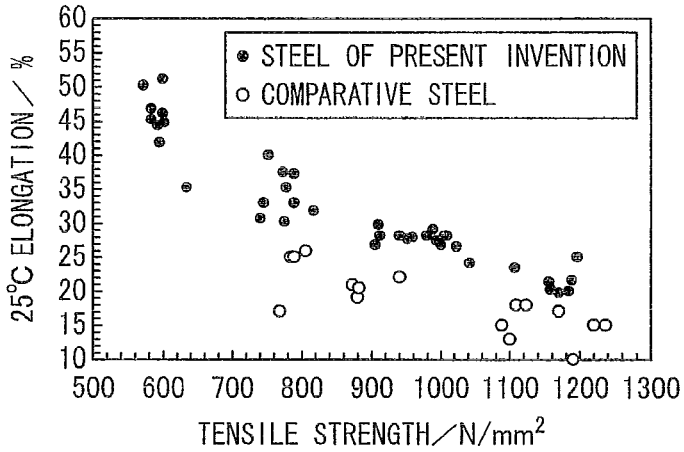
FIG. 1 is a diagram showing the relationship between tensile strength and 25° C. elongation of steel sheets according to Examples and Comparative Examples.

The inventors found that in order to cause the TRIP effect of retained austenite to act not only on elongation but also V-bendability, increasing the stability of a retained austenite phase to a degree of equal to or higher than that until now is effective, and in order to cause the TRIP effect to act on a wide press-forming temperature range, uniformly dispersing retained austenite phases with different stabilities is effective.

However, in a technique of increasing the C concentration in the retained austenite phases using bainite transformation of the retained austenite steel according to the related art, the C concentration may not be increased to a concentration of $T_0$ point or higher described in Non-patent Document 1, and the stability of the retained austenite phase may not be increased.

Here, as a result of the intensive examination of the inventors, it was discovered that an extremely stable retained austenite phase may be obtained by appropriately controlling a C concentration gradient in the retained austenite phase, and austenite phases with different stabilities may be uniformly dispersed by appropriately controlling the grain size distribution of austenite grains in the retained austenite phase.

Hereinafter, a steel sheet according to an embodiment of the present invention made on the basis of the above-described discovery will be described in detail.

First, regarding the steel according to this embodiment and a slab (cast slab) which is the bulk material thereof, the chemical components of steel will be described. Here, "%" representing the amount of each element means mass %.

(Basic Elements)

The chemical components of steel contain C, Si, Mn, and Al as basic elements.

(C: 0.05 to 0.35%)

C is an extremely important element for increasing the strength of steel and ensuring a retained austenite phase. When a C content is less than 0.05%, sufficient strength may not be ensured, and a sufficient retained austenite phase may not be obtained. On the other hand, when the C content exceeds 0.35%, ductility or spot weldability is significantly deteriorated. In consideration of the above-described characteristics, the C content may be specified as a narrower range.

Therefore, regarding the C content, the lower limit thereof is specified as 0.05%, preferably 0.08%, and more preferably 0.15%, and the upper limit thereof is specified as 0.35%, preferably 0.26%, and more preferably 0.22%.

(Si: 0.05 to 2.0%)

Si is an important element in terms of ensuring strength. In a case where a Si content is equal to or higher than 0.05%, an effect of contributing to the generation of the retained austenite phase and ensuring ductility is obtained. On the other hand, in a case where the Si content exceeds 2.0%, such an effect is saturated, and moreover, embrittlement of steel is more likely to occur. In a case where hot-dip galvanizing and chemical conversion treatments need to be facilitated, the upper limit thereof may be specified as 1.8%. In consideration of the above-described characteristics, the Si content may be specified as a narrower range.

Therefore, regarding the Si content, the lower limit thereof is specified as 0.05%, preferably 0.1%, and more preferably 0.5%, and the upper limit thereof is specified as 2.0%, preferably 1.8%, and more preferably 1.6%.

(Mn: 0.8 to 3.0%)

Mn is an important element in terms of ensuring strength. In a case where a Mn content is equal to or higher than 0.8%, an effect of contributing to the generation of the retained austenite phase and ensuring ductility is obtained. On the other hand, in a case where the Mn content exceeds 3.0%, hardenability is increased, the retained austenite phase is transformed into a martensite phase, and thus an excessive increase in strength is more likely to be caused. As a result, products significantly vary, and ductility becomes insufficient. In consideration of the above-described characteristics, the Mn content may be specified as a narrower range.

Therefore, regarding the Mn content, the lower limit thereof is specified as 0.8%, preferably 0.9%, and more preferably 1.2%, and the upper limit thereof is specified as 3.0%, preferably 2.8%, and more preferably 2.6%.

(Al: 0.01 to 2.0%)

In a case where an Al content is equal to or higher than 0.01%, like Si, an effect of contributing to the generation of the retained austenite phase and ensuring ductility is obtained. On the other hand, in a case where the Al content exceeds 2.0%, such an effect is saturated, and steel becomes embrittled. In consideration of the above-described characteristics, the Si content may be specified as a narrower range.

Therefore, regarding the Al content, the lower limit thereof is specified as 0.01%, preferably 0.015%, and more preferably higher than 0.04%, and the upper limit thereof is specified as 2.0%, preferably 1.8%, and more preferably less than 1.4%.

In a case where hot-dip galvanizing is performed, Al deteriorates hot-dip galvanizing properties, and thus it is preferable that the upper limit thereof be 1.8%.

In a case where a large amount of the above-mentioned Si and Al having the same effect is added to the steel, a Si+Al content may be specified.

In this case, regarding the Si+Al content, the lower limit thereof is specified as 0.8%, preferably 0.9%, and more preferably higher than 1.0%, and the upper limit thereof is specified as 4.0%, preferably 3.0%, and more preferably 2.0%.

(Limited Elements)

In the steel described above, the contents of P, S, and N, which are limited elements, are limited as follows.

(P: Equal to or Less than 0.1%)

A P content is limited depending on a required steel sheet strength. When the P content exceeds 0.1%, local ductility is deteriorated due to segregation at grain boundaries, and weldability is deteriorated. Therefore, the P content is limited to be equal to or less than 0.1%.

P is inevitably contained in the steel, and thus the lower limit thereof exceeds 0%. However, excessive cost is incurred to limit the P content to be extremely low. Therefore, the lower limit thereof may be specified as 0.001% or 0.006%. In consideration of the above-described characteristics, the P content may be specified as a narrower range.

Therefore, the P content is limited to be equal to or less than 0.1%, preferably equal to or less than 0.05%, and more preferably equal to or less than 0.01%. In addition, the lower limit thereof may be specified as higher than 0%, 0.001%, or 0.006%.

(S: Equal to or Less than 0.05%)

S is an element that generates MnS and thus deteriorates local ductility and weldability. Therefore, a S content is limited to be equal to or less than 0.05%.

S is inevitably contained in the steel, and thus the lower limit thereof exceeds 0%. However, excessive cost is incurred to limit the S content to be extremely low. Therefore, the lower limit thereof may be specified as 0.0005% or higher than 0.001%. In consideration of the above-described characteristics, the S content may be specified as a narrower range.

Therefore, the S content is limited to be equal to or less than 0.05%, preferably equal to or less than 0.01%, and more preferably less than 0.004%. In addition, the lower limit thereof may be specified as higher than 0%, 0.0005%, or higher than 0.001%.

(N: Equal to or Less than 0.01%)

When a large amount of N is contained, aging characteristics are deteriorated, a precipitation amount of AlN is increased, and thus an effect of Al addition is reduced. Therefore, a N content is limited to be equal to or less than 0.01%.

N is inevitably contained in the steel, and thus the lower limit thereof is specified as higher than 0%. However, excessive cost is incurred to limit the N content to be extremely low, and thus the lower limit thereof may be specified as 0.001% or higher than 0.002%. In consideration of the above-described characteristics, the N content may be specified as a narrower range.

Therefore, the N content is limited to be equal to or less than 0.01%, preferably equal to or less than 0.008%, and more preferably less than 0.005%. In addition, the lower limit thereof may be specified as higher than 0%, 0.001%, or higher than 0.002%.

(Fe and Inevitable Impurities)

The steel described above contains iron and inevitable impurities as the balance. As the inevitable impurities, there are Sn, As, and the like incorporated from scrap. In addition, other elements may be contained in a range that does not hinder the characteristics of the present invention.

(Selective Elements)

The steel described above may contain at least one of Mo, Nb, Ti, V, Cr, W, Ca, Mg, Zr, REM, Cu, Ni, and B as selective elements.

(Mo: 0.01 to 0.5%)

In a case where a Mo content is equal to or higher than 0.01%, an effect of suppressing the generation of a pearlite phase in the steel is obtained. Therefore, Mo is an element that is important in a case where a cooling rate is slow during annealing or in a case where re-heating is performed due to an alloying treatment or the like of plating. However, in a case where the Mo content exceeds 0.5%, ductility or chemical conversion treatment properties may be deteriorated. In order to obtain the balance between higher strength and ductility, it is preferable that the Mo content be equal to or less than 0.3%. In consideration of the above-described characteristics, the Mo content may be specified as a narrower range.

Therefore, in a case where Mo is contained in the steel, the lower limit thereof may be specified as 0.01%, and preferably 0.02%, and the upper limit thereof may be specified as 0.5%, preferably 0.3%, and more preferably 0.2%.

(Nb: 0.005 to 0.1%)

(Ti: 0.005 to 0.2%)

(V: 0.005 to 0.5%)

(Cr: 0.05 to 5.0%)

(W: 0.05 to 5.0%)

Nb, Ti, V, Cr, and W are elements that generate fine carbides, nitrides, or carbonitrides and are effective in ensuring strength. In terms of ensuring strength, the lower limit of Nb may be specified as 0.005%, the lower limit of Ti may be specified as 0.005%, the lower limit of V may be specified as 0.005%, the lower limit of Cr may be specified as 0.05%, and the lower limit of W may be specified as 0.05%, On the other hand, when such elements are excessively added to the steel, the strength of the steel is excessively increased and thus ductility is degraded. In terms of ensuring ductility, the upper limit of Nb may be specified as 0.1%, the upper limit of Ti may be specified as 0.2%, the upper limit of V may be specified as 0.5%, the upper limit of Cr may be specified as 5.0%, and the upper limit of W may be specified as 5.0%, In addition, in consideration of the above-described characteristics, the content of each of the elements may be specified as a narrower range.

Therefore, in a case where Nb is contained in the steel, the lower limit thereof may be specified as 0.005%, and preferably 0.01%, and the upper limit thereof may be specified as 0.1%, preferably 0.05%, and more preferably 0.03%.

In addition, in a case where Ti is contained in the steel, the lower limit thereof may be specified as 0.005%, and preferably 0.01%, and the upper limit thereof may be specified as 0.2%, preferably 0.1%, and more preferably 0.07%.

In addition, in a case where V is contained in the steel, the lower limit thereof may be specified as 0.005%, and preferably 0.01%, and the upper limit thereof may be specified as 0.5%, preferably 0.3%, and more preferably 0.1%.

In addition, in a case where Cr is contained in the steel, the lower limit thereof may be specified as 0.05%, and preferably 0.1%, and the upper limit thereof may be specified as 5.0%, preferably 3.0%, and more preferably 1.0%.

In addition, in a case where W is contained in the steel, the lower limit thereof may be specified as 0.05%, and preferably 0.1%, and the upper limit thereof may be specified as 5.0%, preferably 3.0%, and more preferably 1.0%.

(Ca: 0.0005 to 0.05%)

(Mg: 0.0005 to 0.05%)

(Zr: 0.0005 to 0.05%)

(REM: 0.0005 to 0.05%)

Ca, Mg, Zr, and REM (rare earth elements) control the shapes of sulfides and oxides and enhance local ductility and hole expandability. Therefore, the lower limit of each of the elements may be specified as 0.0005%.

On the other hand, in a case where the steel excessively contains such elements, workability is deteriorated. Therefore, the upper limit of each of the elements may be specified as 0.05%.

In addition, in consideration of the above-described characteristics, the content of each of the elements may be specified as a narrower range.

Therefore, in a case where Ca is contained in the steel, the lower limit thereof may be specified as 0.0005%, and preferably 0.001%, and the upper limit thereof may be specified as 0.05%, preferably 0.01%, and more preferably 0.005%.

In addition, in a case where Mg is contained in the steel, the lower limit thereof may be specified as 0.0005%, and preferably 0.001%, and the upper limit thereof may be specified as 0.05%, preferably 0.01%, and more preferably 0.005%.

In addition, in a case where Zr is contained in the steel, the lower limit thereof may be specified as 0.0005%, and preferably 0.001%, and the upper limit thereof may be specified as 0.05%, preferably 0.01%, and more preferably 0.005%.

In addition, in a case where REM is contained in the steel, the lower limit thereof may be specified as 0.0005%, and preferably 0.001%, and the upper limit thereof may be specified as 0.05%, preferably 0.01%, and more preferably 0.005%.

(Cu: 0.02 to 2.0%)

(Ni: 0.02 to 1.0%)

(B: 0.0003 to 0.007%)

Cu, Ni, and B may obtain an effect of slowing down transformation and increasing the strength of the steel. Therefore, the lower limit of Cu may be specified as 0.02%, the lower limit of Ni may be specified as 0.02%, and the lower limit of B may be specified as 0.0003%.

On the other hand, when each of the elements is excessively added, hardenability is excessively increased, ferrite transformation and bainite transformation slow down, and thus an increase in the C concentration in the retained austenite phase slows down. Therefore, the upper limit of Cu may be specified as 2.0%, the upper limit of Ni may be specified as 1.0%, and the upper limit of B may be specified as 0.007%.

In addition, in consideration of the above-described characteristics, the content of each of the elements may be specified as a narrower range.

Therefore, in a case where Cu is contained in the steel, the lower limit thereof may be specified as 0.02%, and preferably 0.04%, and the upper limit thereof may be specified as 2.0%, preferably 1.5%, and more preferably 1.0%.

In addition, in a case where Ni is contained in the steel, the lower limit thereof may be specified as 0.02%, and preferably 0.04%, and the upper limit thereof may be specified as 1.0%, preferably 0.7%, and more preferably 0.5%.

In addition, in a case where B is contained in the steel, the lower limit thereof may be specified as 0.0003%, and preferably 0.0005%, and the upper limit thereof may be specified as 0.007%, preferably 0.005%, and more preferably 0.003%.

Next, the steel structure of the steel sheet according to this embodiment will be described. Here, "%" regarding the steel structure means an area ratio, unless otherwise described.

The steel structure of the steel sheet according to this embodiment contains 50% or higher, preferably 60%, and more preferably 70% or higher of a total of a ferrite phase, a bainite phase, and a tempered martensite phase with respect to the entire structure in terms of area ratio. In addition, the steel structure contains 3% or higher, preferably higher than 5%, and more preferably higher than 10% of a retained austenite phase with respect to the entire structure. The tempered martensite phase may be contained depending on a required strength of the steel sheet, and 0% thereof may be contained. In addition, when 5% or less of the pearlite phase is contained, the pearlite phase does not significantly deteriorate the material quality even though it is contained in the steel structure, and thus the pearlite phase may be contained in a range of equal to or less than 5%.

In a case where the steel sheet contains less than 50% of a ferrite phase, a bainite phase, and a tempered martensite, the C concentration in the retained austenite phase may not be increased, and thus it is difficult to ensure the stability of the phases even though the retained austenite phase has a concentration gradient. Therefore, V-bendability is deteriorated. On the other hand, when the steel sheet contains more than 95% a ferrite phase, a bainite phase, and a tempered martensite, it is difficult to ensure 3% or higher of the retained austenite phase, resulting in the degradation of elongation. Therefore, 95% or less is preferable.

In the steel sheet according to this embodiment, the C concentration distribution of the crystal grains of the retained austenite phase is appropriately controlled. That is, the C concentration (Cgb) at a phase interface at which the crystal grains of the retained austenite phase border the ferrite phase, the bainite phase, or the tempered martensite phase is controlled to be higher than the C concentration (Cgc) at a position of the center of gravity of the crystal grains. Accordingly, the stability of the retained austenite phase at the phase interface is increased, and thus excellent elongation and V-bendability may be exhibited.

More specifically, in a case where 50% or more, preferably 55% or more, and more preferably 60% or more of the crystal grains of the retained austenite phase satisfy Expression 1 as follows, an effect of increasing the stability of the entire retained austenite phase is obtained:

$$Cgb/Cgc \geq 1.2 \quad \text{(Expression 1).}$$

Cgb and Cgc (and CgbS, CgcS, CgbL, and CgcL described later) may be measured by any measurement method as long as the measurement method guarantees accuracy. For example, they may be obtained by measuring a C concentration at a pitch of 0.5 μm or less using a FE-SEM-attached EPMA.

Here, the C concentration (Cgb) at a phase interface is referred to as the C concentration at a measurement point which is closest to the grain boundary on the crystal grain side. However, depending on the measurement conditions, there may be cases where Cgb is measured to be low due to an effect of the outside of the crystal grains. In this case, the highest C concentration in the vicinity of the grain boundary is referred to as Cgb.

Measuring a local C concentration at an interface is impossible in the current technology. However, as a result of intensive examination by the inventors, it was determined that a sufficient effect is obtained when the condition of Expression 1 is satisfied during typical measurement.

The average grain size of the crystal grains of the retained austenite phase may be equal to or less than 10 μm, preferably 4 μm, and more preferably equal to or less than 2 μm. The "grain size" mentioned here means an average circle-equivalent diameter, and the "average grain size" means a number average thereof. When the average grain size exceeds 10 μm, the dispersion of the retained austenite phase is coarsened, and thus the TRIP effect may not be sufficiently exhibited. Therefore, excellent elongation may not be obtained. In addition, in a case where the average grain size of the crystal grains of the retained austenite phase is less than 1 μm, it is difficult to obtain a phase interface having a predetermined C concentration gradient, and excellent V-bendability may not be obtained.

An average carbon concentration in the retained austenite phase significantly contributes to the stability of the retained austenite, like the C concentration gradient. When the average C concentration is less than 0.7%, the stability of the retained austenite is extremely reduced, the TRIP effect may not be effectively obtained, and thus elongation is degraded. On the other hand, when the average C concentration exceeds 1.5%, an effect of improving elongation is saturated, and thus manufacturing cost is increased. Therefore, regarding the average carbon concentration in the retained austenite phase, the upper limit thereof may be specified as 0.7%, preferably 0.8%, and more preferably 0.9%, and the lower limit thereof may be specified as 1.5%, preferably 1.4%, and more preferably 1.3%.

In the steel sheet according to this embodiment, retained austenite phases with different stabilities may be uniformly dispersed by appropriately distributing the grain sizes of the crystal grains of the retained austenite phases. In this case, the retained austenite phase with a high stability contributes to press-formability in an initial stage of press-forming at, for example, about 25° C., and the retained austenite phase with a low stability contributes to press-formability in a late stage of the press-forming at, for example, about 150° C. Therefore, in addition to high elongation and V-bendability, excellent press-forming stability may also be exhibited.

In order to ensure press-forming stability, the crystal grains of the retained austenite phase need to be dispersed so that the TRIP effect is always exhibited even though a die temperature is changed during a continuous press. Here, in the steel sheet according to this embodiment, it is possible to realize excellent press-formability that does not depend on the die temperature by uniformly dispersing the crystal grains of the retained austenite phases having different stabilities.

Specifically, it is preferable that 40% or more of the crystal grains of the retained austenite phase in the steel sheet have small-diameter crystal grains and grain sizes of equal to or greater than 1 μm and less than 2 μm, and that 20% or more of the crystal grains are large-diameter crystal grains having grain sizes of equal to or greater than 2 μm. In this case, austenite grains having different stabilities are uniformly disposed, and thus excellent press-forming stability may be realized.

Grains (crystal grains with extremely small diameters) having sizes of less than 0.5 μm provide a C concentration gradient with extreme difficulty, become the crystal grains of an extremely unstable retained austenite phase, and thus have a low contribution to press-formability. Grains having sizes of equal to or greater than 0.5 μm and less than 2 μm (small-diameter crystal grains) provide a possibility for maintaining a high concentration gradient in a formed product because a large amount of carbon is incorporated from adjacent grains. By causing the small-diameter crystal grains to be present at a ratio of 40% or more of the total crystal grains, this effect may be exhibited. Grains having sizes of equal to or greater than 2 μm (large-diameter crystal grains) become crystal grains of the retained austenite phase having a relatively low stability, in which an amount of carbon incorporated from adjacent grains is small and a temperature gradient is small. Thus retained austenite phase is likely to cause the TRIP effect in a low press range. By causing the large-diameter crystal grains to be present at a ratio of 20% or more of the total crystal gains, this effect may be exhibited.

Moreover, in the steel sheet according to this embodiment, an appropriate C concentration gradient may be provided for each size of the crystal grains of the retained austenite phase. More specifically, it is preferable that 50% or more, preferably 55% or more, and more preferably 60% or more of the small-diameter crystal grains satisfy Expression 2, wherein the carbon concentration at a position of the center of gravity is CgcS and the carbon concentration at a grain boundary position is CgbS, and 50% or more preferably 55% or more, and more preferably 60% or more of the large-diameter crystal grains satisfy Expression 3, wherein the carbon concentration at a position of the center of gravity is CgcL and the carbon concentration at a grain boundary position is CgbL:

$$CgbS/CgcS>1.3 \quad \text{(Expression 2)}$$

$$1.3>CgbL/CgcL>1.1 \quad \text{(Expression 3).}$$

As described above, by providing an appropriate C concentration gradient for each size of the crystal grains of the retained austenite phase, stable and high press-formability may be exhibited in a relatively low-temperature state at, for example, about 25° C. and in a relatively high-temperature state, for example, about 150° C.

When the small-diameter crystal grains having a value of CgbS/CgcS of higher than 1.3 are present at a ratio of equal to or higher than 50% with respect to the entire small-diameter crystal grains, the small-diameter crystal grains have high stability, and thus elongation in a low-temperature state in an initial stage of press-forming may be enhanced. On the other hand, such stable retained austenite has degraded elongation in a high-temperature state in a late stage of press-forming. In order to compensate for this, when the large-diameter crystal grains having a value of CgbL/CgcL of higher than 1.1 and less than 1.3 are present at a ratio of equal to or higher than 50% with respect to the entire large-diameter crystal grains, the large-diameter crystal grains have low stability, which is effective in improving elongation in the high-temperature state in the late stage of a press. Here, when the value of CgbL/CgcL is less than 1.1, the crystal grains act on elongation at a higher temperature, resulting in the deterioration of elongation at 150° C. or less.

When such a concentration ratio is ensured, high press-formability may be ensured in a range from a low temperature to a high temperature. However, in order to ensure this effect for the entire structure, it is necessary that 50% or more, preferably 55% or more, and more preferably 60% or more of the small-diameter crystal grains satisfy Expression 2. When this is not satisfied, the TRIP effect thereof is low, and thus press-formability at a low temperature is deteriorated. On the other hand, when the large-diameter crystal grains satisfy Expression 3, press-formability may be obtained in a high-temperature region. Even regarding such large-diameter crystal gains, in order to ensure this effect for the entire structure, it is necessary that 50% or more, preferably 55% or more, and more preferably 60% or more of the large-diameter grains satisfy Expression 3.

The steel sheet according to this embodiment may have a galvanized film or a galvannealed film on at least one surface.

Hereinafter, a method of manufacturing a steel sheet according to the embodiment of the present invention will be described.

In the embodiment of the present invention, a hot-rolling process, an air-cooling process, a coiling process, a cold-rolling process, an annealing process, a holding process, and a final cooling process are at least included. Hereinafter, each of the processes will be described in detail.

(Hot-Rolling Process)

In the hot-rolling process, hot rolling is performed on a cast slab (slab) immediately after being continuously cast or a cast slab re-heated to 1100° C. or higher after being cooled to 1100° C. or less, thereby manufacturing a hot-rolled steel sheet. In a case where the re-heated cast slab is used, a homogenization treatment is insufficiently performed at a re-heating temperature of less than 1100° C., and thus strength and V-bendability are degraded. A higher finishing temperature in the hot-rolling process is more preferable in terms of the recrystallization and growth of austenite grains and thus is set to be equal to or higher than 850° C. and equal to or less than 970° C. When the finishing temperature of the hot rolling is less than 850° C., (ferrite+austenite) two-phase range rolling is caused, resulting in the degradation of ductility. On the other hand, when the finishing temperature of the hot rolling exceeds 970° C., austenite grains become coarse, the fraction of a ferrite phase is reduced, and thus ductility is degraded.

In the case where the C concentration gradient of the crystal grains in the retained austenite phase is uniformly dispersed, a lower rolling reduction amount is more preferable in the final two passes (a stage before the final stage and the final stage) during rolling, and thus the rolling reduction amount in each stage may be set to be equal to or less than 20%. In addition, the rolling reduction ratio in the final one pass (the final pass) may be set to be equal to or less than 15% or equal to or less than 10%. Accordingly, the sizes of the crystal grains of the retained austenite phase may be dispersed, so that the press-forming stability of the steel sheet may be enhanced. When the rolling reduction amount in each stage exceeds 20%, recrystallization of austenite grains proceeds, and thus it becomes difficult to obtain crystal grains having grain sizes (circle-equivalent diameter) of equal to or greater than 2 μm in the final structure.

(Air-Cooling Process)

In the air-cooling process, cooling (air cooling) is performed on the hot-rolled steel sheet obtained as described above for a time of equal to or longer than 1 second and equal to or shorter than 10 seconds. When the air-cooling time is shorter than 1 second, recrystallization and growth of austenite grains are insufficient, and thus the crystal grains in the retained austenite phase of the final structure are reduced. On the other hand, when the air-cooling time exceeds 10 seconds, austenite grains become coarse, uniformity is eliminated, and thus elongation is deteriorated. The air-cooling time is set to, preferably 5 seconds or less, and more preferably 3 seconds or less.

(Coiling Process)

In the coiling process, after the air-cooled hot-rolled steel sheet is cooled at an average cooling rate of equal to or higher than 10° C./sec and equal to or less than 200° C./sec to a temperature range of equal to or less than 650° C., the resultant is coiled in a temperature range of equal to or less than 650° C., preferably equal to or less than 600° C., and more preferably equal to or less than 400° C. When the average cooling rate is less than 10° C./sec or the coiling temperature exceeds 650° C., a pearlite phase that significantly deteriorates V-bendability is generated. When the average cooling rate exceeds 200° C./sec, an effect of suppressing pearlite is saturated, and variations in cooling end-point temperature become significant. Therefore, it is difficult to ensure a stable material.

Therefore, regarding the average cooling rate, the lower limit thereof is set to 10° C./sec, preferably 30° C./sec, and more preferably 40° C./sec, and the upper limit thereof is set to 200° C./sec, preferably 150° C./sec, and more preferably 120° C./sec. In addition, regarding the coiling temperature, the lower limit thereof is set to 200° C., preferably 400° C., and more preferably 650° C., and the upper limit thereof is set to 600° C. or 550° C.

(Cold-Rolling Process)

In the cold-rolling process, the coiled hot-rolled steel sheet is pickled, and thereafter the resultant is subjected to cold rolling at a rolling reduction ratio of 40% or higher, thereby manufacturing a cold-rolled steel sheet. In a rolling reduction ratio of less than 40%, recrystallization or reverse transformation during annealing is suppressed, resulting in the degradation of elongation. Here, the upper limit of the rolling reduction ratio is not particularly specified and may be 90% or 70%.

(Annealing Process)

In the annealing process, annealing is performed on the cold-rolled steel sheet at a maximum temperature of equal to or higher than 700° C. and equal to or less than 900° C. When the maximum temperature is less than 700° C., the recrystallization of a ferrite phase during annealing slows down, resulting in the degradation of elongation. When the maximum temperature exceeds 900° C., the fraction of martensite is increased, resulting in the degradation of elongation.

Therefore, regarding the annealing maximum temperature, the lower limit thereof is set to 700° C., preferably 720° C., and more preferably 750° C., and the upper limit thereof is set to 900° C., preferably 880° C., and more preferably less than 850° C.

After the annealing process, for the purpose of suppressing yield point elongation, skin-pass rolling may be performed by about 1%.

(Holding Process)

In order to perform an overaging treatment (hereinafter, OA), in the holding process, the annealed cold-rolled steel sheet is cooled in a temperature range of equal to or higher than 350° C. and equal to or less than 480° C. at an average cooling rate of equal to or higher than 0.1° C./sec and equal to or less than 200° C./sec, and is held in this temperature for a time of equal to or longer than 1 second and equal to or shorter than 1000 seconds. During cooling after the annealing, in order to fix the structure and efficiently cause bainite transformation, the average cooling rate is set to be equal to or higher than 0.1° C./sec and equal to or less than 200° C./sec. When the average cooling rate is less than 0.1° C./sec, transformation may not be controlled. On the other hand, when the average cooling rate exceeds 200° C./sec, the effect is saturated, and temperature controllability of a cooling end-point temperature that is most important to generate retained austenite is significantly deteriorated. Therefore, regarding the average cooling rate, the lower limit thereof is set to 0.1° C./sec, preferably 2° C./sec, and more preferably 3° C./sec, and the upper limit thereof is set to 200° C./sec, preferably 150° C./sec, and more preferably 120° C./sec.

A cooling end-point temperature and holding thereafter are important to control the generation of bainite and determine the C concentration of retained austenite. When the cooling end-point temperature is less than 350° C., a large amount of martensite is generated, and thus steel strength is excessively increased. Moreover, it is difficult to cause austenite to be retained. Therefore, the degradation of elongation is extremely increased. When the cooling end-point temperature exceeds 480° C., bainite transformation slows down and moreover, the generation of cementite occurs during holding, degrading an increase in the concentration of C in retained austenite. Therefore, regarding the cooling end-point temperature and the holding temperature, the lower limit thereof is set to 350° C., preferably 380° C., and more preferably 390° C., and the upper limit thereof is set to 480° C., preferably 470° C., and more preferably 460° C.

A holding time is set to be equal to or longer than 1 second and equal to or shorter than 1000 seconds. When the holding time is shorter than 1 second, insufficient bainite transformation occurs, and an increase in the C concentration in retained austenite is insufficient. When the holding time exceeds 1000 seconds, cementite is generated in the austenite phase, and thus a reduction in the C concentration is more likely to occur. Therefore, regarding the holding time, the lower limit thereof is set to 1 second, preferably 10 seconds, and more preferably 40 seconds, and the upper limit thereof is set to 1000 seconds, preferably 600 seconds, and more preferably 400 seconds.

(Final Cooling Process)

In the final cooling process, the cold-rolled steel sheet after holding is primarily cooled in a temperature range from 350° C. to 220° C. at an average cooling rate of equal to or higher than 5° C./sec and equal to or less than 25° C./sec, and is then secondarily cooled in a temperature range from 120° C. to near room temperature at an average cooling rate of equal to or higher than 100° C./second and equal to or less than 5° C./sec.

Faint transformation that occurs during cooling after OA has an important role to increase a C concentration of the vicinity of the grain boundary in austenite. Therefore, the steel sheet is cooled during primary cooling in a temperature range from 350° C. to 220° C. at an average cooling rate of equal to or higher than 5° C./sec and equal to or less than 25° C./sec. When the cooling rate in the temperature range from 350° C. to 220° C. exceeds 25° C./sec, transformation does not proceed therebetween, and an increase in the C concentration in austenite does not occur. On the other hand, when the cooling rate in the temperature range from 350° C. to 220° C. is less than 5° C./sec, the diffusion of C in austenite proceeds, and thus the concentration gradient of C is reduced.

Therefore, regarding the average cooling rate during primary cooling, the lower limit thereof is set to 5° C./sec, preferably 6° C./sec, and more preferably 7° C./sec, and the upper limit thereof is set to 20° C./sec, preferably 19° C./sec, and more preferably 18° C./sec.

In addition, in a low-temperature range of equal to or less than 120° C., the diffusion of C is further restricted, and transformation is not likely to occur. Therefore, during secondary cooling, the steel sheet is cooled in a temperature range from 120° C. to near room temperature at an average cooling rate of equal to or higher than 100° C./sec, and a C concentration gradient in the austenite phase of from 350° C. to 220° C. is achieved. Otherwise, during secondary cooling, the steel sheet is cooled in a temperature range from 120° C. to near room temperature at an average cooling rate of equal to or less than 5° C./sec so as to cause the C concentration gradient in the austenite phase to become more significant. When the average cooling rate is higher than 5° C./sec and less than 100° C./sec during secondary cooling, transformation does not occur, and a reduction in the C concentration at the grain boundary occurs.

Therefore, the average cooling rate during secondary cooling is set to be equal to or less than 5° C./sec, preferably 4° C./sec, and more preferably 3° C./sec, or is set to be equal to or higher than 100° C./sec, preferably 120° C./sec, and more preferably 150° C./sec.

According to the method of manufacturing a steel sheet according to this embodiment described above, by controlling the cooling condition after the concentration of C in the retained austenite phase is increased through bainite transformation, it is possible to control the C concentration gradient in the retained austenite phase so as to increase the C concentration of the grain boundary portion. In addition, with the increase in the C concentration in the austenite phase during cooling after annealing, it is possible to increase the stability of the retained austenite phase.

In addition, in a case where the C concentration gradient of the retained austenite phase is uniformly dispersed by dispersing the sizes of the crystal grains of the retained austenite phase, the press-forming stability of the steel sheet may be enhanced.

This technique may be applied to manufacturing of a hot-dip galvanized steel sheet. In this case, after the above-described holding process, the steel sheet is immersed into a hot-dip galvanizing bath before the final cooling process. Moreover, it is possible to add an alloying treatment after immersion. The alloying treatment is performed in a temperature range of equal to or higher than 500° C. and 580° C. At a temperature of less than 500° C., insufficient alloying occurs, and at a temperature of higher than 580° C., overalloying occurs, and thus corrosion resistance is significantly deteriorated.

In addition, the present invention is not influenced by casting conditions. For example, an influence of a casting method (continuous casing or ingot casting) and a difference in slab thickness is small, and a special cast such as a thin slab and a hot-rolling method may be used. In addition, electroplating may be performed on the steel sheet.

EXAMPLES

The present invention will further be described on the basis of Examples. The conditions of the Examples are condition examples that are employed to confirm the possibility of embodiment and effects of the present invention, and the present invention is not limited to the condition examples. The present invention may employ various conditions without departing from the concept of the present invention as long as the object of the present invention is achieved.

First, cast slabs A to V (steel components of Examples) having chemical components shown in Table 1 and cast slabs a to g (steel components of Comparative Examples) were manufactured.

TABLE 1

| Steel | C | Si | Mn | Al | P | S | N | Selective element |
|---|---|---|---|---|---|---|---|---|
| | | | | | mass % | | | |
| A | 0.15 | 1.9 | 2.5 | 0.031 | 0.006 | 0.002 | 0.002 | Cu: 0.5, Ni: 0.5 |
| B | 0.18 | 1.2 | 1.7 | 0.031 | 0.007 | 0.003 | 0.002 | Ca: 0.003 |
| C | 0.09 | 1.3 | 1.5 | 0.034 | 0.006 | 0.001 | 0.002 | REM: 0.005 |
| D | 0.22 | 1.2 | 2.1 | 0.041 | 0.007 | 0.002 | 0.003 | — |
| E | 0.19 | 1.2 | 1.8 | 0.045 | 0.007 | 0.003 | 0.002 | — |
| F | 0.30 | 1.2 | 1.9 | 0.035 | 0.006 | 0.001 | 0.002 | — |
| G | 0.12 | 1.3 | 1.5 | 0.042 | 0.008 | 0.001 | 0.002 | — |
| H | 0.23 | 1.2 | 2.3 | 0.035 | 0.007 | 0.003 | 0.003 | — |
| I | 0.30 | 1.2 | 2.3 | 0.035 | 0.007 | 0.003 | 0.003 | — |
| J | 0.34 | 1.0 | 1.4 | 0.050 | 0.006 | 0.002 | 0.002 | V: 0.1, W: 0.3 |
| K | 0.07 | 1.5 | 2.9 | 0.015 | 0.008 | 0.003 | 0.009 | Nb: 0.05, Mg: 0.004 |
| L | 0.15 | 0.06 | 1.5 | 0.600 | 0.006 | 0.002 | 0.003 | Mo: 0.12 |
| M | 0.15 | 0.11 | 2.0 | 1.1 | 0.007 | 0.003 | 0.002 | Ca: 0.003 |

TABLE 1-continued

| Steel | C | Si | Mn | Al | P | S | N | Selective element |
|---|---|---|---|---|---|---|---|---|
| | | | | | mass % | | | |
| N | 0.15 | 0.11 | 1.3 | 0.902 | 0.006 | 0.001 | 0.003 | REM: 0.005 |
| O | 0.22 | 0.10 | 2.0 | 1.9 | 0.007 | 0.002 | 0.002 | B: 0.005 |
| P | 0.22 | 0.15 | 1.3 | 0.903 | 0.007 | 0.003 | 0.002 | Mo: 0.15, Ti: 0.02, Nb: 0.02 |
| Q | 0.25 | 0.50 | 1.9 | 1.0 | 0.006 | 0.002 | 0.002 | Mo: 0.15 |
| R | 0.30 | 0.09 | 1.2 | 1.0 | 0.008 | 0.003 | 0.002 | Ti: 0.07 |
| S | 0.30 | 0.07 | 1.6 | 1.4 | 0.006 | 0.001 | 0.003 | Mo: 0.15 |
| T | 0.25 | 0.50 | 1.7 | 1.4 | 0.007 | 0.001 | 0.004 | Mo: 0.15 |
| U | 0.22 | 0.09 | 0.91 | 1.0 | 0.006 | 0.002 | 0.002 | Mo: 0.1, V: 0.1, Cr: 0.3 |
| V | 0.22 | 0.10 | 1.4 | 1.0 | 0.09 | 0.045 | 0.003 | Mo: 0.2, Zr: 0.005 |
| a | 0.40 | 1.6 | 2.0 | 0.030 | 0.006 | 0.001 | 0.002 | — |
| b | 0.02 | 1.2 | 2.0 | 0.035 | 0.007 | 0.001 | 0.003 | — |
| c | 0.22 | 1.2 | 1.3 | 0.041 | 0.006 | 0.11 | 0.003 | Mo: 0.2 |
| d | 0.25 | 3.0 | 1.0 | 0.040 | 0.006 | 0.001 | 0.002 | Mo: 0.22 |
| e | 0.25 | 1.2 | 4.0 | 0.035 | 0.007 | 0.001 | 0.004 | — |
| f | 0.30 | 0.03 | 1.4 | 0.005 | 0.008 | 0.001 | 0.004 | — |
| g | 0.30 | 0.01 | 1.2 | 3.5 | 0.008 | 0.003 | 0.002 | Mo: 0.6 |

Hot-rolled steel sheets were manufactured by performing hot rolling on these cast slabs. During hot rolling, rolling reduction ratios in sixth and seventh stages of the rolling corresponding to the final two passes and finishing temperature were as shown in Table 2. Thereafter, the hot-rolled steel sheet that was subjected to air cooling for a predetermined time was cooled to about 550° C. at an average cooling rate of 60° C./sec, and was then subjected to coiling at about 540° C. The coiled hot-rolled steel sheet was subjected to pickling, and was thereafter subjected to cold rolling at a rolling reduction ratio of 50%, thereby manufacturing a cold-rolled steel sheet.

In addition, an annealing treatment was performed at a maximum annealing temperature shown in Table 2. After annealing, for the purpose of suppressing yield point elongation, skin-pass rolling was performed by about 1%.

Thereafter, in order to perform an averaging treatment, the steel sheet after the annealing was cooled and held. A cooling rate, a holding temperature, and a holding time here are shown in Table 2. In addition, regarding some steel sheets, the steel sheets after holding were immersed into a hot-dip galvanizing bath, and were subjected to an alloying treatment at a predetermined alloying temperature.

Lastly, primary cooling (cooling in a range of 350 to 220° C.) and secondary cooling (cooling in a range of 120° C. to 20° C.) were performed on the cold-rolled steel sheet at a predetermined cooling rate, thereby manufacturing steel sheets A1 to V1 and a1 to g1.

TABLE 2

| Steel sheet | 6th rolling reduction ratio % | 7th rolling reduction ratio % | Finish temperature ° C. | Air-cooling time s | Maximum annealing temperature ° C. | Cooling rate ° C./sec | Holding temperature ° C. | Holding time sec | Alloying temperature ° C. | Final primary cooling rate ° C./sec | Final secondary cooling rate ° C./sec |
|---|---|---|---|---|---|---|---|---|---|---|---|
| A1 | 15 | 10 | 879 | 2.5 | 850 | 40 | 400 | 400 | No plating | 14 | 2 |
| A2 | 15 | 10 | 890 | 2.5 | 850 | 150 | 400 | 300 | No plating | 15 | 2 |
| A3 | 40 | 40 | 890 | 2 | 850 | 150 | 400 | 100 | No plating | 15 | 1 |
| A4 | 25 | 25 | 890 | 2 | 850 | 150 | 400 | 100 | No plating | 15 | 2 |
| A5 | 20 | 15 | 890 | 2 | 850 | 150 | 400 | 100 | No plating | 15 | 2 |
| B1 | 12 | 12 | 890 | 4 | 880 | 40 | 400 | 300 | 440 | 20 | 3 |
| B2 | 12 | 12 | 890 | 4 | 850 | 4 | 450 | 40 | 440 | 20 | 2 |
| B3 | 12 | 12 | 895 | 4 | 980 | 40 | 425 | 40 | 400 | 15 | 2 |
| C1 | 15 | 10 | 901 | 2.5 | 850 | 40 | 425 | 300 | 460 | 15 | 1 |
| C2 | 15 | 10 | 895 | 2.5 | 850 | 4 | 450 | 40 | 460 | 10 | 2 |
| D1 | 15 | 10 | 892 | 2.5 | 775 | 50 | 400 | 300 | No plating | 10 | 150 |
| D2 | 15 | 10 | 880 | 2.5 | 800 | 100 | 425 | 300 | No plating | 10 | 150 |

TABLE 2-continued

| Steel sheet | 6th rolling reduction ratio % | 7th rolling reduction ratio % | Finish temperature ° C. | Air-cooling time s | Maximum annealing temperature ° C. | Cooling rate ° C./sec | Holding temperature ° C. | Holding time sec | Alloying temperature ° C. | Final primary cooling rate ° C./sec | Final secondary cooling rate ° C./sec |
|---|---|---|---|---|---|---|---|---|---|---|---|
| D3 | 15 | 10 | 888 | 2.5 | 660 | 100 | 425 | 300 | No plating | 8 | 150 |
| D4 | 15 | 10 | 888 | 2.5 | 660 | 100 | 425 | 300 | No plating | 40 | 3 |
| E1 | 12 | 12 | 883 | 3 | 800 | 40 | 425 | 300 | No plating | 8 | 150 |
| E2 | 12 | 12 | 900 | 3 | 800 | 100 | 425 | 300 | No plating | 8 | 150 |
| E3 | 12 | 12 | 900 | 3 | 800 | 100 | 425 | 300 | No plating | 8 | 50 |
| F1 | 15 | 10 | 896 | 3 | 775 | 50 | 400 | 200 | No plating | 15 | 3 |
| F2 | 15 | 10 | 895 | 3 | 780 | 100 | 425 | 300 | No plating | 15 | 3 |
| F3 | 15 | 10 | 885 | 3 | 780 | 100 | 325 | 300 | No plating | 10 | 150 |
| F4 | 15 | 10 | 880 | 3 | 780 | 100 | 550 | 300 | No plating | 10 | 150 |
| G1 | 10 | 8 | 906 | 2.5 | 800 | 40 | 425 | 300 | No plating | 10 | 150 |
| G2 | 10 | 8 | 900 | 2.5 | 800 | 100 | 400 | 300 | No plating | 10 | 150 |
| H1 | 10 | 8 | 890 | 2.5 | 775 | 50 | 400 | 150 | No plating | 15 | 2 |
| H2 | 10 | 8 | 900 | 2.5 | 800 | 100 | 425 | 200 | No plating | 15 | 2 |
| H3 | 10 | 8 | 900 | 2.5 | 800 | 120 | 425 | 1200 | No plating | 15 | 2 |
| H4 | 10 | 8 | 890 | 2.5 | 800 | 120 | 425 | 200 | No plating | 2 | 150 |
| I1 | 15 | 10 | 886 | 2.5 | 775 | 50 | 400 | 300 | No plating | 15 | 1 |
| I2 | 15 | 10 | 890 | 2.5 | 800 | 100 | 425 | 200 | No plating | 15 | 2 |
| J1 | 15 | 10 | 887 | 2.5 | 800 | 40 | 425 | 300 | No plating | 15 | 2 |
| J2 | 15 | 10 | 892 | 15.0 | 800 | 40 | 425 | 300 | No plating | 15 | 3 |
| K1 | 15 | 10 | 881 | 2.5 | 800 | 40 | 400 | 400 | No plating | 15 | 3 |
| L1 | 15 | 10 | 891 | 2 | 850 | 4 | 450 | 40 | 470 | 15 | 2 |
| L2 | 15 | 10 | 900 | 2 | 775 | 40 | 450 | 400 | 470 | 15 | 3 |
| M1 | 15 | 10 | 888 | 2.5 | 800 | 4 | 425 | 40 | 500 | 15 | 4 |
| M2 | 15 | 10 | 890 | 0.5 | 800 | 40 | 425 | 300 | 500 | 15 | 2 |
| N1 | 15 | 10 | 905 | 2.5 | 800 | 4 | 425 | 40 | 500 | 20 | 3 |
| N2 | 15 | 10 | 900 | 2.5 | 800 | 40 | 450 | 300 | 500 | 20 | 3 |
| O1 | 15 | 10 | 905 | 3 | 800 | 4 | 400 | 40 | 500 | 20 | 2 |
| O2 | 15 | 10 | 900 | 3 | 800 | 40 | 425 | 300 | 500 | 20 | 2 |
| P1 | 10 | 8 | 902 | 3 | 800 | 4 | 450 | 40 | 520 | 10 | 150 |
| P2 | 10 | 8 | 890 | 3 | 800 | 40 | 450 | 400 | 520 | 10 | 150 |
| Q1 | 10 | 8 | 882 | 2.5 | 775 | 4 | 425 | 40 | 520 | 20 | 2 |
| Q2 | 10 | 8 | 890 | 2.5 | 775 | 50 | 450 | 350 | 520 | 20 | 3 |
| R1 | 10 | 8 | 893 | 2.5 | 775 | 4 | 400 | 40 | 500 | 15 | 1 |
| R2 | 10 | 8 | 880 | 2.5 | 825 | 40 | 425 | 300 | 500 | 15 | 2 |
| S1 | 18 | 15 | 888 | 4 | 825 | 4 | 425 | 40 | 500 | 15 | 3 |
| S2 | 18 | 15 | 895 | 4 | 825 | 40 | 425 | 300 | 500 | 15 | 2 |
| T1 | 18 | 15 | 908 | 4 | 825 | 4 | 425 | 40 | 520 | 15 | 1 |
| T2 | 18 | 15 | 900 | 4 | 775 | 40 | 450 | 350 | 520 | 15 | 2 |
| U1 | 15 | 10 | 909 | 4 | 800 | 4 | 425 | 40 | 520 | 20 | 3 |
| V1 | 15 | 10 | 899 | 4 | 800 | 4 | 425 | 40 | 520 | 20 | 2 |
| a1 | 15 | 10 | 882 | 2.5 | 775 | 40 | 400 | 300 | No plating | 20 | 2 |
| b1 | 15 | 10 | 907 | 2.5 | 775 | 100 | 400 | 300 | No plating | 20 | 2 |
| c1 | 15 | 10 | 905 | 2.5 | 800 | 40 | 400 | 300 | 500 | 20 | 2 |
| d1 | 15 | 10 | 921 | 2.5 | 800 | 40 | 400 | 300 | 500 | 20 | 2 |
| e1 | 15 | 10 | 879 | 2.5 | 800 | 4 | 450 | 40 | No plating | 20 | 2 |
| f1 | 15 | 10 | 891 | 2.5 | 775 | 100 | 400 | 300 | No plating | 20 | 2 |
| g1 | 15 | 10 | 913 | 2.5 | 800 | 40 | 400 | 300 | 500 | 20 | 2 |

The steel structures of the steel sheets obtained as described above and steel sheet characteristics are shown in Tables 3 and 4. Regarding the steel structures, "proportion of ferrite+bainite+tempered martensite", "proportion of retained austenite", "proportion of crystal grains that satisfy Expression (1)", "proportion of small-diameter crystal grains", "proportion of large-diameter crystal grains", "proportion of small-diameter crystal grains that satisfy Expression (2)", "proportion of large-diameter crystal grains that satisfy Expression (3)", "average grain size of crystal grains", and "average C concentration in retained austenite phase" were measured. In addition, regarding the steel sheet characteristics, "tensile strength", "25° C. elongation", "V-bendability", and "150° C. elongation" were evaluated.

TABLE 3

| Steel sheet | Proportion of ferrite + bainite + tempered martensite % | Proportion of retained austenite % | Proportion of retained austenite grains that satisfy Expression (1) % | Proportion of small-diameter retained austenite grains % | Proportion of large-diameter retained austenite grains % | Proportion of retained austenite grains that satisfy Expression (2) % | Proportion of retained austenite grains that satisfy Expression (3) % |
|---|---|---|---|---|---|---|---|
| A1 | 78 | 20 | 64 | 62 | 23 | 64 | 60 |
| A2 | 79 | 19 | 66 | 61 | 24 | 66 | 62 |
| A3 | 77 | 21 | 67 | 85 | 5 | 67 | 63 |
| A4 | 77 | 20 | 68 | 70 | 15 | 68 | 64 |
| A5 | 78 | 21 | 67 | 70 | 22 | 66 | 65 |

TABLE 3-continued

| Steel sheet | Proportion of ferrite + bainite + tempered martensite % | Proportion of retained austenite % | Proportion of retained austenite grains that satisfy Expression (1) % | Proportion of small-diameter retained austenite grains % | Proportion of large-diameter retained austenite grains % | Proportion of retained austenite grains that satisfy Expression (2) % | Proportion of retained austenite grains that satisfy Expression (3) % |
|---|---|---|---|---|---|---|---|
| B1 | 89 | 10 | 75 | 57 | 33 | 76 | 72 |
| B2 | 88 | 10 | 74 | 52 | 43 | 76 | 72 |
| B3 | 86 | 2 | 64 | 50 | 45 | 65 | 61 |
| C1 | 93 | 10 | 67 | 62 | 23 | 66 | 62 |
| C2 | 92 | 10 | 56 | 60 | 30 | 55 | 52 |
| D1 | 83 | 16 | 58 | 61 | 24 | 56 | 53 |
| D2 | 83 | 15 | 57 | 62 | 23 | 55 | 52 |
| D3 | 80 | 18 | 55 | 62 | 23 | 51 | 51 |
| D4 | 81 | 17 | 31 | 62 | 22 | 22 | 25 |
| E1 | 87 | 11 | 55 | 58 | 27 | 51 | 51 |
| E2 | 88 | 11 | 55 | 58 | 27 | 52 | 52 |
| E3 | 88 | 11 | 36 | 55 | 26 | 25 | 30 |
| F1 | 82 | 16 | 67 | 57 | 28 | 66 | 63 |
| F2 | 83 | 15 | 66 | 59 | 26 | 66 | 62 |
| F3 | 39 | 2 | 56 | 59 | 31 | 55 | 52 |
| F4 | 45 | 11 | 57 | 68 | 22 | 56 | 53 |
| G1 | 93 | 11 | 56 | 57 | 33 | 55 | 52 |
| G2 | 93 | 10 | 56 | 55 | 35 | 56 | 52 |
| H1 | 80 | 18 | 65 | 52 | 38 | 66 | 62 |
| H2 | 78 | 20 | 66 | 55 | 35 | 66 | 63 |
| H3 | 80 | 0 | — | — | — | — | — |
| H4 | 78 | 20 | 35 | 55 | 35 | 38 | 20 |
| I1 | 78 | 20 | 66 | 61 | 24 | 66 | 62 |
| I2 | 78 | 20 | 67 | 61 | 24 | 66 | 63 |
| J1 | 88 | 11 | 67 | 62 | 23 | 66 | 62 |
| J2 | 88 | 10 | 64 | 23 | 62 | 65 | 62 |
| K1 | 79 | 10 | 66 | 62 | 23 | 65 | 61 |
| L1 | 93 | 11 | 66 | 59 | 26 | 66 | 62 |
| L2 | 93 | 11 | 67 | 62 | 23 | 66 | 63 |
| M1 | 88 | 11 | 66 | 59 | 31 | 66 | 62 |
| M2 | 88 | 11 | 66 | 77 | 8 | 65 | 62 |
| N1 | 93 | 11 | 75 | 59 | 31 | 76 | 72 |
| N2 | 93 | 10 | 75 | 63 | 22 | 77 | 72 |
| O1 | 85 | 14 | 75 | 53 | 37 | 77 | 73 |
| O2 | 85 | 14 | 74 | 59 | 26 | 76 | 71 |
| P1 | 89 | 10 | 55 | 45 | 50 | 56 | 52 |
| P2 | 89 | 10 | 57 | 56 | 34 | 56 | 53 |
| Q1 | 81 | 17 | 74 | 43 | 47 | 76 | 72 |
| Q2 | 83 | 16 | 75 | 59 | 31 | 76 | 72 |
| R1 | 85 | 14 | 65 | 46 | 49 | 66 | 63 |
| R2 | 84 | 14 | 66 | 57 | 33 | 66 | 62 |
| S1 | 82 | 16 | 65 | 60 | 30 | 65 | 62 |
| S2 | 82 | 16 | 67 | 62 | 23 | 66 | 63 |
| T1 | 84 | 15 | 66 | 60 | 30 | 66 | 62 |
| T2 | 84 | 15 | 66 | 64 | 21 | 65 | 62 |
| U1 | 93 | 6 | 74 | 53 | 42 | 76 | 72 |
| V1 | 88 | 11 | 75 | 53 | 42 | 77 | 72 |
| a1 | 40 | 15 | 75 | 61 | 24 | 76 | 72 |
| b1 | 97 | 1 | 75 | 61 | 24 | 76 | 72 |
| c1 | 87 | 11 | 75 | 61 | 24 | 77 | 72 |
| d1 | 84 | 14 | 75 | 61 | 24 | 76 | 72 |
| e1 | 65 | 22 | 75 | 60 | 30 | 77 | 72 |
| f1 | 86 | 0 | — | — | — | — | — |
| g1 | 79 | 4 | 75 | 61 | 24 | 76 | 71 |

TABLE 4

| Steel sheet | Average grain size of crystal grains μm | Average C concentration in retained austenite phase % | Tensile strength N/mm$^2$ | 25° C. elongation % | V-bendability mm | 150° C. elongation % |
|---|---|---|---|---|---|---|
| A1 | 1.5 | 0.8 | 1170 | 20 | 1.7 | 21 |
| A2 | 1.6 | 0.8 | 1158 | 20 | 1.7 | 21 |
| A3 | 1.1 | 0.8 | 1238 | 15 | 3.9 | 5 |
| A4 | 1.4 | 0.8 | 1190 | 10 | 2.7 | 16 |
| A5 | 1.5 | 0.8 | 1183 | 20 | 1.8 | 24 |

TABLE 4-continued

| Steel sheet | Average grain size of crystal grains μm | Average C concentration in retained austenite phase % | Tensile strength N/mm$^2$ | 25° C. elongation % | V-bendability mm | 150° C. elongation % |
|---|---|---|---|---|---|---|
| B1 | 1.7 | 1.4 | 753 | 40 | 0.4 | 44 |
| B2 | 1.9 | 1.4 | 773 | 37 | 0.5 | 45 |
| B3 | 1.9 | 1.4 | 873 | 21 | 1.2 | 23 |
| C1 | 1.5 | 0.9 | 596 | 42 | No cracking | 44 |
| C2 | 1.7 | 0.9 | 636 | 35 | No cracking | 41 |

TABLE 4-continued

| Steel sheet | Average grain size of crystal grains μm | Average C concentration in retained austenite phase % | Tensile strength N/mm$^2$ | 25° C. elongation % | V-bendability mm | 150° C. elongation % |
|---|---|---|---|---|---|---|
| D1 | 1.6 | 1.4 | 994 | 28 | 1.1 | 32 |
| D2 | 1.5 | 1.4 | 979 | 28 | 1.2 | 32 |
| D3 | 1.5 | 1.2 | 1100 | 13 | 2.5 | 13 |
| D4 | 1.5 | 1.3 | 1110 | 18 | 2.5 | 20 |
| E1 | 1.6 | 1.4 | 817 | 32 | 0.6 | 39 |
| E2 | 1.6 | 1.4 | 790 | 33 | No cracking | 40 |
| E3 | 1.6 | 1.4 | 785 | 25 | 2.3 | 30 |
| F1 | 1.7 | 1.4 | 1006 | 28 | 1.3 | 32 |
| F2 | 1.6 | 1.4 | 990 | 29 | 1.2 | 32 |
| F3 | 1.7 | 1.4 | 1220 | 15 | 2.9 | 16 |
| F4 | 1.5 | 0.6 | 880 | 19 | 1.6 | 19 |
| G1 | 1.7 | 1.4 | 584 | 45 | No cracking | 55 |
| G2 | 1.8 | 1.4 | 592 | 44 | No cracking | 55 |
| H1 | 1.8 | 1.3 | 1108 | 23 | 1.7 | 29 |
| H2 | 1.8 | 1.2 | 1188 | 22 | 1.9 | 25 |
| H3 | — | — | 1090 | 15 | 3.4 | 15 |
| H4 | 1.8 | 1.2 | 1170 | 17 | 3.3 | 16 |
| I1 | 1.6 | 1.5 | 1196 | 25 | 1.9 | 27 |
| I2 | 1.6 | 1.5 | 1199 | 25 | 2.0 | 27 |
| J1 | 1.5 | 1.4 | 790 | 37 | 0.5 | 40 |
| J2 | 2.5 | 1.1 | 770 | 17 | 1.3 | 34 |
| K1 | 1.5 | 0.9 | 1157 | 21 | 1.7 | 23 |
| L1 | 1.6 | 1.2 | 601 | 45 | No cracking | 49 |
| L2 | 1.5 | 1.2 | 599 | 46 | No cracking | 49 |
| M1 | 1.7 | 0.8 | 777 | 30 | No cracking | 36 |
| M2 | 1.2 | 0.8 | 790 | 25 | 1.3 | 15 |
| N1 | 1.7 | 1.2 | 572 | 50 | No cracking | 54 |
| N2 | 1.5 | 1.3 | 600 | 51 | No cracking | 51 |
| O1 | 1.8 | 1.0 | 913 | 28 | 0.8 | 32 |
| O2 | 1.6 | 1.0 | 910 | 30 | 0.8 | 31 |
| P1 | 2.0 | 1.2 | 741 | 31 | 0.3 | 43 |
| P2 | 1.7 | 1.2 | 745 | 33 | 0.3 | 40 |
| Q1 | 2.0 | 0.9 | 1043 | 24 | 1.4 | 28 |
| Q2 | 1.7 | 1.0 | 1001 | 27 | 1.2 | 29 |
| R1 | 2.0 | 1.2 | 905 | 27 | 0.9 | 36 |
| R2 | 1.7 | 1.2 | 940 | 28 | 1.0 | 32 |
| S1 | 1.7 | 1.2 | 1025 | 27 | 1.3 | 30 |
| S2 | 1.5 | 1.3 | 1011 | 28 | 1.2 | 30 |
| T1 | 1.7 | 1.1 | 951 | 28 | 0.9 | 31 |
| T2 | 1.5 | 1.1 | 960 | 28 | 0.9 | 29 |
| U1 | 1.9 | 1.2 | 583 | 47 | No cracking | 55 |
| V1 | 1.9 | 1.2 | 779 | 35 | No cracking | 42 |
| a1 | 1.6 | 1.2 | 1519 | 15 | 2.9 | 10 |
| b1 | 1.6 | 1.1 | 426 | 42 | 0.3 | 42 |
| c1 | 1.6 | 1.2 | 807 | 26 | 2.6 | 29 |
| d1 | 1.6 | 1.2 | 942 | 22 | 2.4 | 15 |
| e1 | 1.7 | 0.2 | 1710 | 12 | 3.5 | 11 |
| f1 | — | — | 883 | 20 | 2.4 | 21 |
| g1 | 1.6 | 1.0 | 1124 | 18 | 3.0 | 19 |

For observation of the identification of the structure and positions and measurement of an average grain size (average circle-equivalent diameter) and occupancy ratio, a cross-section in a steel sheet rolling direction or a cross-section perpendicular to the rolling direction was corroded by Nital reagent for quantification through observation using an optical microscope at a magnification of 500× to 1000×.

Measurement of "ratio of retained austenite phase" was performed on a surface that was chemically polished to a ¼ thickness from the surface layer of the steel sheet, and retained austenite was quantified and obtained from the integrated intensities of the (200) and (211) planes of ferrite and the integrated intensities of the (200), (220), and (311) planes of austenite by monochromic MoKα rays.

In addition, "average C concentration in retained austenite phase" (Cγ) was calculated by the following Expression A by obtaining a lattice constant (unit: angstroms) from the angles of reflection of the (200) plane, the (220) plane, and the (311) plane of austenite through ray analysis using Cu-Kα rays.

$$C\gamma = (\text{lattice constant} - 3.572)/0.033 \quad \text{(Expression A)}$$

"25° C. elongation" and "150° C. elongation" were evaluated at the temperatures of 25° C. and 150° C. by elongation in the C direction of a JIS #5 tensile test piece.

"V-bendability" was evaluated by a minimum R in which no cracking occurred during a V-bending test. In the V-bending test, a test piece of 30 mm×200 mm was bent at 90 degrees using V blocks having various R. A distance between the supports was 95 mm, and a wrinkle pressing force (BHF) at the supports was 98 kN. Determination of cracking was performed through visual observation or observation using a magnifying glass, and those having cracks or constriction on the surface were determined as cracking.

Among the steels a to g of Table 1, the steel a did not satisfy the C upper limit that is specified by the present invention, and the steel b did not satisfy the C lower limit. The steels c, d, and e did not satisfy the upper limits of S, Si, and Mn, respectively. The steel f did not satisfy the lower limits of Si and Al. The steel g did not satisfy the lower limit of Si and the upper limit of Al.

The steel sheet A3 and the steel sheet A4 are steel sheets manufactured by setting the rolling reduction ratios in the final two passes to be high.

The steel sheet D3 is a steel sheet manufactured by setting the maximum temperature during annealing to be low.

The steel sheet D4 is a steel sheet manufactured by setting the final primary cooling speed to be high.

The steel sheet E3 is a steel sheet manufactured by setting the final secondary cooling speed to 50° C./sec.

The steel sheet F3 is a steel sheet manufactured by setting the holding temperature to be low.

The steel sheet F4 is a steel sheet manufactured by setting the holding temperature to be high.

The steel sheet H3 is a steel sheet manufactured by setting the holding time to be long.

The steel sheet H4 is a steel sheet manufactured by setting the final primary cooling speed to be low.

The steel sheet J2 is a steel sheet manufactured by setting the air-cooling time to be long.

The steel sheet M2 is a steel sheet manufactured by setting the air cooling-time to be short.

In the steel sheet a1, the fraction of ferrite+bainite is out of range, and in the steel sheet b1, the fraction of austenite is equal to or less than a range. The steel sheet e1 has a low average C concentration in austenite. The steel sheet f1 and the steel sheet g1 cannot ensure the fractions of austenite.

Figure 2:
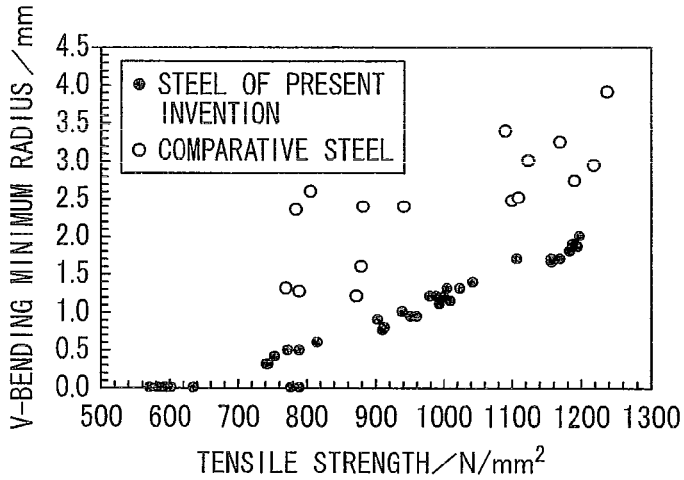
FIG. 2 is a diagram showing the relationship between tensile strength and V-bending minimum radius (V-bendability) of the steel sheets according to the Examples and the Comparative Examples.

FIG. 1 is a diagram showing the relationship between tensile strength and 25° C. elongation of the steel sheets according to the Examples and the Comparative Examples, and FIG. 2 is a diagram showing the relationship between tensile strength and V-bendability regarding the same steel sheets. From FIGS. 1 and 2, it can be seen that both high elongation and V-bendability are obtained according to the steel sheet and the method of manufacturing a steel sheet according to the present invention.

Figure 3:
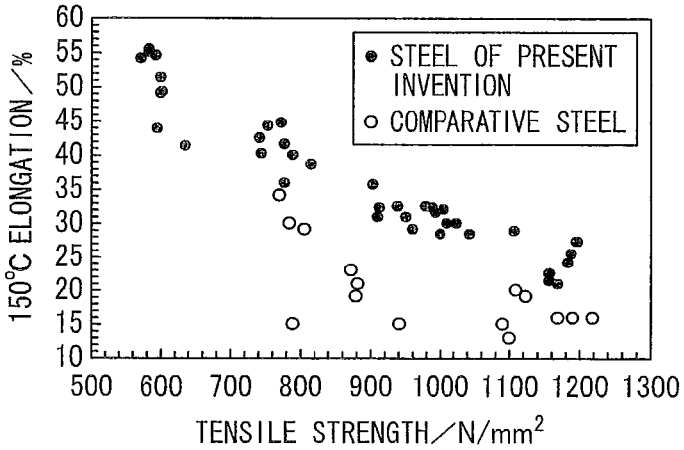
FIG. 3 a diagram showing the relationship between tensile strength and 150° C. elongation according to the Examples and the Comparative Examples.

In addition, FIG. 3 is a diagram showing the relationship between tensile strength and 150° C. elongation according to the Examples and the Comparative Examples. From FIGS. 1 and 3, it can be seen that high elongation is realized at both temperatures of 25° C. and 150° C. according to the steel sheet and the method of manufacturing a steel sheet according to the present invention.

INDUSTRIAL APPLICABILITY

According to the present invention, the present invention may provide a steel sheet having higher elongation and V-bendability compared to that according to the related art and moreover has excellent press-forming stability, and a method of manufacturing the same.

The invention claimed is:

1. A steel sheet comprising:

as chemical components, by mass %, 0.05% to 0.35% of C;

0.05% to 2.0% of Si;

0.8% to 3.0% of Mn;

0.01% to 2.0% of Al;

less than or equal to 0.1% of P;

less than or equal to 0.05% of S;

less than or equal to 0.01% of N; and the balance including iron and inevitable impurities, wherein:

the steel sheet has a 25° C. elongation of not less than 20%, and a 150° C. elongation of not less than 21%;

the steel sheet comprises in area ratio, 3% or more of a retained austenite phase, 50% or more of a total of a ferrite phase, a bainite phase and a tempered martensite phase;

a number ratio of 50% or more of crystal grains of the retained austenite phase satisfy Expression 1, a number ratio of 40% or more of the crystal grains of the retained austenite phase are small-diameter crystal grains having an average grain size greater than or equal to 1 μm and less than 2 μm, a number ratio of 20% or more of the crystal grains of the retained austenite phase are large diameter crystal grains having an average grain size greater than or equal to 2 μm, a number ratio of 51% or more of the small diameter crystal grains satisfy Expression 2, a number ratio of 51% or more of the large diameter crystal grains satisfy Expression 3, $$Cgb/Cgc \geq 1.2; \quad \text{Expression 1:}$$

$$CgbS/CgcS > 1.3; \quad \text{Expression 2:}$$

$$1.3 > CgbL/CgcL > 1.1; \quad \text{Expression 3:}$$

wherein:

in Expression 1, Cgc represents a carbon concentration at a center of gravity, and Cgb represents a carbon concentration at a grain boundary;

in Expression 2, CgcS represents a carbon concentration of small particles at a center of gravity, and CgbS represents a carbon concentration of small particles at a grain boundary;

in Expression 3, CgcL represents a carbon concentration of large particles at a center of gravity, and CgbL represents a carbon concentration of large particles at a grain boundary.

2. The steel sheet according to claim 1, further comprising, in the chemical components, by mass %, at least one of:

0.01% to 0.5% of Mo;

0.005% to 0.1% of Nb;

0.005% to 0.2% of Ti;

0.005% to 0.5% of V;

0.05% to 5.0% of Cr;

0.05% to 5.0% of W;

0.0005% to 0.05% of Ca;

0.0005% to 0.05% of Mg;

0.0005% to 0.05% of Zr;

0.0005% to 0.05% of rare earth metals;

0.02% to 2.0% of Cu;

0.02% to 1.0% of Ni; and 0.0003% to 0.007% of B.

3. The steel sheet according to claim 1, wherein an average carbon concentration in the retained austenite phase is equal to or higher than 0.7% and equal to or less than 1.5%.

4. The steel sheet according to claim 1, wherein the steel sheet has a galvanized film provided to at least one surface.

5. The steel sheet according to claim 1, wherein the steel sheet has a galvannealed film provided to at least one surface.

6. The steel sheet according to claim 2, wherein the steel sheet has a galvanized film provided to at least one surface.

7. The steel sheet according to claim 2, wherein the steel sheet has a galvannealed film provided to at least one surface.

8. The steel sheet according to claim 3, wherein the steel sheet has a galvanized film provided to at least one surface.

9. The steel sheet according to claim 3, wherein the steel sheet has a galvannealed film provided to at least one surface.

10. A method of manufacturing a steel sheet of claim 1, the method comprising:

a hot-rolling process of manufacturing a hot-rolled steel sheet by performing hot rolling on a slab having a composition as recited in claim 1 at a finishing temperature of equal to or higher than 850° C. and equal to or less than 970° C.;

an air-cooling process of performing air cooling on the hot-rolled steel sheet for a time of equal to or longer than 1 second and equal to or shorter than 10 seconds;

a coiling process of cooling the air-cooled hot-rolled steel sheet to a temperature range of equal to or less than 650° C. at an average cooling rate of equal to or higher than 10° C./sec and equal to or less than 200° C./sec and thereafter coiling the steel sheet in a temperature range of equal to or less than 650° C.;

a cold-rolling process of performing pickling on the coiled hot-rolled steel sheet at a rolling reduction ratio of equal to or higher than 40% and thereafter performing cold rolling on the steel sheet, thereby manufacturing a cold-rolled steel sheet;

an annealing process of performing annealing on the cold-rolled steel sheet at a maximum temperature of equal to or higher than 700° C. and equal to or less than 900° C.;

a holding process of cooling the annealed cold-rolled steel sheet in a temperature range of equal to or higher than 350° C. and equal to or less than 480° C. at an average cooling rate of equal to or higher than 0.1° C./sec and equal to or less than 200° C./sec, and holding the steel sheet in this temperature range for a time of equal to or longer than 1 second and equal to or shorter than 1000 seconds; and a final cooling process of primarily cooling the cold-rolled steel sheet in a temperature range from 350° C. to 220° C. at an average cooling rage of equal to or higher than 5° C./sec and equal to or less than 25° C./sec, and secondarily cooling the steel sheet in a temperature range from 120° C. to near room temperature at an average cooling rate of equal to or higher than 100° C./sec or equal to or less than 5° C./sec, wherein the hot-rolling process comprises multiple passes of rolling, wherein the rolling is performed with a strain amount of equal to or less than 20% in a sixth pass and with a strain amount of equal to or less than 15% in a seventh pass, wherein the sixth and seventh passes are the final two passes in the hot rolling process.

11. The method according to claim 10, wherein a slab which is re-heated to 1100° C. or higher after being cooled to 1100° C. or less is used in the hot-rolling process.

12. The method according to claim 10, further comprising an immersion process of immersing the steel sheet in a hot-dip galvanizing bath after the holding process.

13. The method according to claim 12 further comprising an alloying treatment process of performing an alloying treatment in a range of equal to or higher than 500° C. and equal to or less than 580° C. after the immersion process.

14. A method of manufacturing a steel sheet of claim 2, the method comprising:

a hot-rolling process of manufacturing a hot-rolled steel sheet by performing hot rolling on a slab having a composition as recited in claim 2 at a finishing temperature of equal to or higher than 850° C. and equal to or less than 970° C.;

an air-cooling process of performing air cooling on the hot-rolled steel sheet for a time of equal to or longer than 1 second and equal to or shorter than 10 seconds;

a coiling process of cooling the air-cooled hot-rolled steel sheet to a temperature range of equal to or less than 650° C. at an average cooling rate of equal to or higher than 10° C./sec and equal to or less than 200° C./sec and thereafter coiling the steel sheet in a temperature range of equal to or less than 650° C.;

a cold-rolling process of performing pickling on the coiled hot-rolled steel sheet at a rolling reduction ratio of equal to or higher than 40% and thereafter performing cold rolling on the steel sheet, thereby manufacturing a cold-rolled steel sheet;

an annealing process of performing annealing on the cold-rolled steel sheet at a maximum temperature of equal to or higher than 700° C. and equal to or less than 900° C.;

a holding process of cooling the annealed cold-rolled steel sheet in a temperature range of equal to or higher than 350° C. and equal to or less than 480° C. at an average cooling rate of equal to or higher than 0.1° C./sec and equal to or less than 200° C./sec, and holding the steel sheet in this temperature range for a time of equal to or longer than 1 second and equal to or shorter than 1000 seconds; and a final cooling process of primarily cooling the cold-rolled steel sheet in a temperature range from 350° C. to 220° C. at an average cooling rage of equal to or higher than 5° C./sec and equal to or less than 25° C./sec, and secondarily cooling the steel sheet in a temperature range from 120° C. to near room temperature at an average cooling rate of equal to or higher than 100° C./sec or equal to or less than 5° C./sec, wherein the hot-rolling process comprises multiple passes of rolling, wherein the rolling is performed with a strain amount of equal to or less than 20% in a sixth pass and with a strain amount of equal to or less than 15% in a seventh pass, wherein the sixth and seventh passes are the final two passes in the hot rolling process.

15. The method according to claim 14, wherein a slab which is re-heated to 1100° C. or higher after being cooled to 1100° C. or less is used in the hot-rolling process.

16. The method according to claim 14, further comprising an immersion process of immersing the steel sheet in a hot-dip galvanizing bath after the holding process.

17. The method according to claim 16 further comprising an alloying treatment process of performing an alloying treatment in a range of equal to or higher than 500° C. and equal to or less than 580° C. after the immersion process.

* * * * *